US005461786A

United States Patent [19]

Miller

[11] Patent Number: 5,461,786

[45] Date of Patent: Oct. 31, 1995

[54] LOCK BLADE KNIFE

[76] Inventor: Ted Miller, Rte. 2, Box 242, Vinita, Okla. 74301

[21] Appl. No.: 393,652

[22] Filed: Feb. 24, 1995

[51] Int. Cl.[6] ..... B26B 1/04

[52] U.S. Cl. ..... 30/161; 30/155

[58] Field of Search ..... 30/155, 158, 159, 30/160, 161, 331

[56] References Cited

U.S. PATENT DOCUMENTS

| | | | |
|---|---|---|---|
| 1,451,607 | 4/1922 | Bates . | |
| 3,868,774 | 3/1975 | Miori | 30/161 |
| 4,124,939 | 11/1978 | Onoue | 30/161 |
| 4,173,068 | 11/1979 | Cargill | 30/161 |
| 4,541,175 | 9/1985 | Boyd et al. | 30/161 |
| 4,570,341 | 2/1986 | Konneker | 30/161 |
| 4,811,486 | 3/1989 | Cunningham | 30/161 |
| 4,837,932 | 6/1989 | Elsener | 30/161 |
| 4,985,998 | 1/1991 | Howard | 30/158 |

*Primary Examiner*—Hwei-Siu Payer
*Attorney, Agent, or Firm*—William S. Dorman

[57] ABSTRACT

A lock blade knife having a handle portion and a blade, the handle portion having a pair of spaced side plates which enclose the blade between them together with a spring which is urged towards the blade. One end of the spring is provided with a pawl which is received in a notch at one end of the knife blade when the blade is in the open position. When the pawl of the spring engages the notch of the blade, the latter is locked in open position. One plate is provided with a T-shaped slot consisting of a vertical oval slot and a transverse intersecting slot. A lever consisting of a button attached to a piece of spring steel which is bent at right angles is received in the T-shaped slot. The spring steel includes a vertical portion which connects at right angles to a horizontal portion, the horizontal portion having a pair of horizontally extending arms which bear against the edge of the horizontal slot. An outer end of the horizontal portion terminates in a finger which is received in a hole along an inboard side edge of the spring. Thus, when pushing down on the button, the ends of the arms will cause the lever to pivot to urge the spring in a direction away from the blade and cause the pawl to move out of the notch, permitting the knife blade to be closed.

4 Claims, 3 Drawing Sheets

LOCK BLADE KNIFE

FIELD OF THE INVENTION

The present invention relates to a lock blade knife of the type having a blade which locks automatically when moved to the open position. More particularly, the present invention relates to a novel mechanism for releasing the lock.

THE PRIOR ART

A preliminary search was conducted on the present invention and the following listed patents were uncovered in the search:

| Inventor | Patent No. | Issue Date |
|---|---|---|
| Bates | 1,451,007 | April 10, 1923 |
| Onoue | 4,124,939 | November 14, 1978 |
| Cargill | 4,173,068 | November 6, 1979 |
| Elsener | 4,837,932 | June 13, 1989 |

Bates U.S. Pat. No. 1,451,607 shows a knife 10 having a blade 13 and a leaf spring 14. The blade 12 is locked in the open position by means of a finger 15 on the leaf spring which engages with a notch on the blade 12. A lever 20 is provided to release the blade 12 from its locked position. By lifting up on the end of the lever 20, the opposite end 21 bears against the leaf spring 14 so as to urge the finger 15 out of the notch 17.

Cargill U.S. Pat. No. 4,173,068 shows a knife 1 having a blade 2 and a main spring 6. The blade 2 is locked in the open position, as shown in FIG. 3, by means of the lug **6*a* on the spring which is received in the recess 2*b* on the blade 2. A locking lug 2*a* forms one end of the locking recess 2*b*. The unlocking of the blade from the FIG. 3 position is effected by means of an unlocking bolster 4, which is shown in FIGS. 1, 5, 6 and 9. As described in Column 3, lines 29 through 37, the blade 2 is unlocked by moving the unlocking bolster upwardly, as shown in FIG. 7, relative to the remaining portions of the handle. The movement of the unlocking bolster 4 also elevates the left end of the main spring 6 (FIG. 9) sufficiently to disengage locking lug 6*a* from the notch 2*b*. Thereafter, the blade 2** can be manually closed.

Onoue U.S. Pat. No. 4,124,939 shows a knife having a blade 2 and a spring 3. The blade 2 is locked in the open position by means of a tooth **3*a* which engages a notch 2*c* in the tang 2*a* of the blade 2. The blade is unlocked by means of a lever 4 having a cammed surface 4*b*. When the lever 4 is rotated, the cammed surface 4*b* contacts the tang 3*a* and lifts it out of the recess 2*c* so as to permit closing of the blade 2**.

Elsener U.S. Pat. No. 4,837,932 has a slidable pawl 49 which is moved by thumb action (FIG. 8) to release a blade 20 from its locked and open position. The knife also includes a spring 22 having a portion 39 which engages the tang 24 of the blade 20 to lock the blade in the closed position as shown in FIGS. 1 and 3. The spring 22 is provided with a key aperture 50 and a ratchet tooth 41. The pawl 49 is provided with a pawl key 26 which is urged into position behind the ratchet tooth 41 by means of a spring 46. When it is desired to release the blade 20 from its locked and open position, the pawl 49 is engaged by the thumb and moved in the direction shown in FIG. 8 towards the handle of the knife. This movement will push the pawl key 26 past the ratchet tooth 41 so that the blade can be closed as shown in FIG. 4.

SUMMARY OF THE INVENTION

The present invention involves a knife having a handle portion and a blade. The handle portion includes a pair of spaced upper and lower side plates which enclose the blade between them. The blade is pivotally mounted between the plates so as to be movable from a closed position within the handle to an open position where the blade extends to one side of the handle in alignment therewith. Also enclosed between the side plates is a spring which is urged towards the blade. One end of the spring is provided with a finger or pawl which is received in a notch at one end of the knife blade when the blade is in the open position. When the pawl of the spring engages the notch of the blade, the latter is locked in open position. The blade is also provided with a narrow recess into which the user can insert his thumbnail to open the blade from the closed position.

The upper plate is provided with a T-shaped slot consisting of a vertical oval slot and a narrow horizontal and intersecting slot representing the arm of the T. An operator member or lever consists of a button attached to a piece of spring steel which is bent at right angles. The spring steel portion includes a flat vertical portion which connects with a horizontal portion to form the right angle referred to above. The horizontal portion includes a pair of horizontally extending arms. Forward of the arms, the horizontal member is of reduced width, this width being essentially equal to or less than the width of the T-shaped slot. The outer end of the horizontal portion terminates in a finger. The lever is received in the T-shaped slot such that the lowermost finger is received in a hole along the inboard side edge of the spring to the right of its pivot point. The horizontally extending arms of the horizontal portion bear against the edge of the horizontal slot.

Thus, when pushing down on the button, the ends of the arms will cause the lever to pivot so as to urge the spring in an outward (upper) direction away from the blade. This will cause the finger or pawl to move out of the notch, permitting the knife blade to be closed.

Figure 4A:
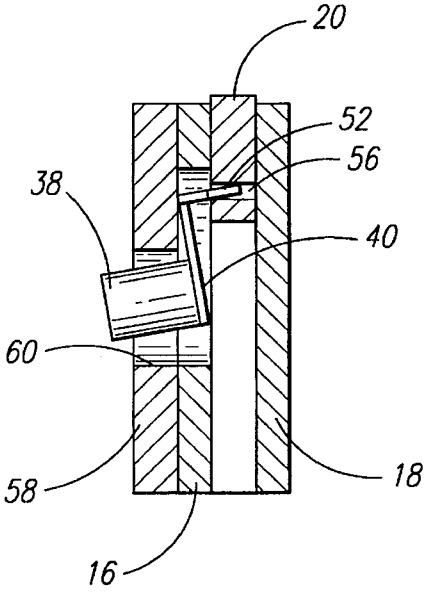
FIG. 4 is a cross-sectional view taken along section line 4—4 of FIG. 1.
Figure 4:
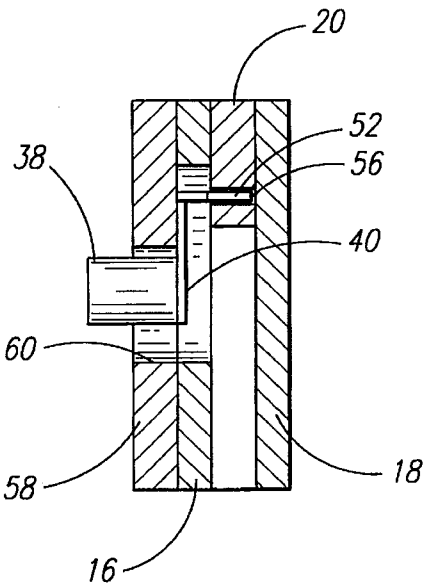

FIG. **4*a* is a view similar to FIG. 4** but showing the button/lever in its depressed condition.

Figure 5:
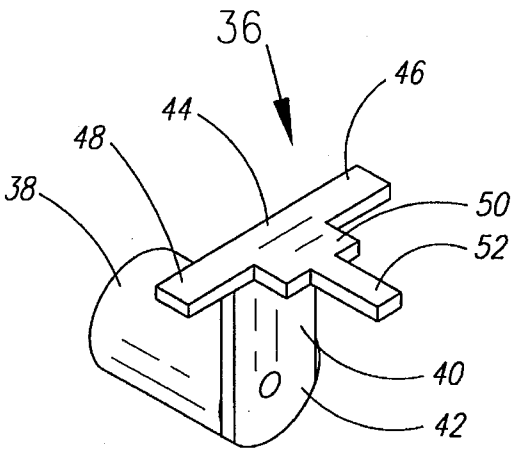

FIG. 5 is a perspective view of the button/lever by itself.

Figure 1:
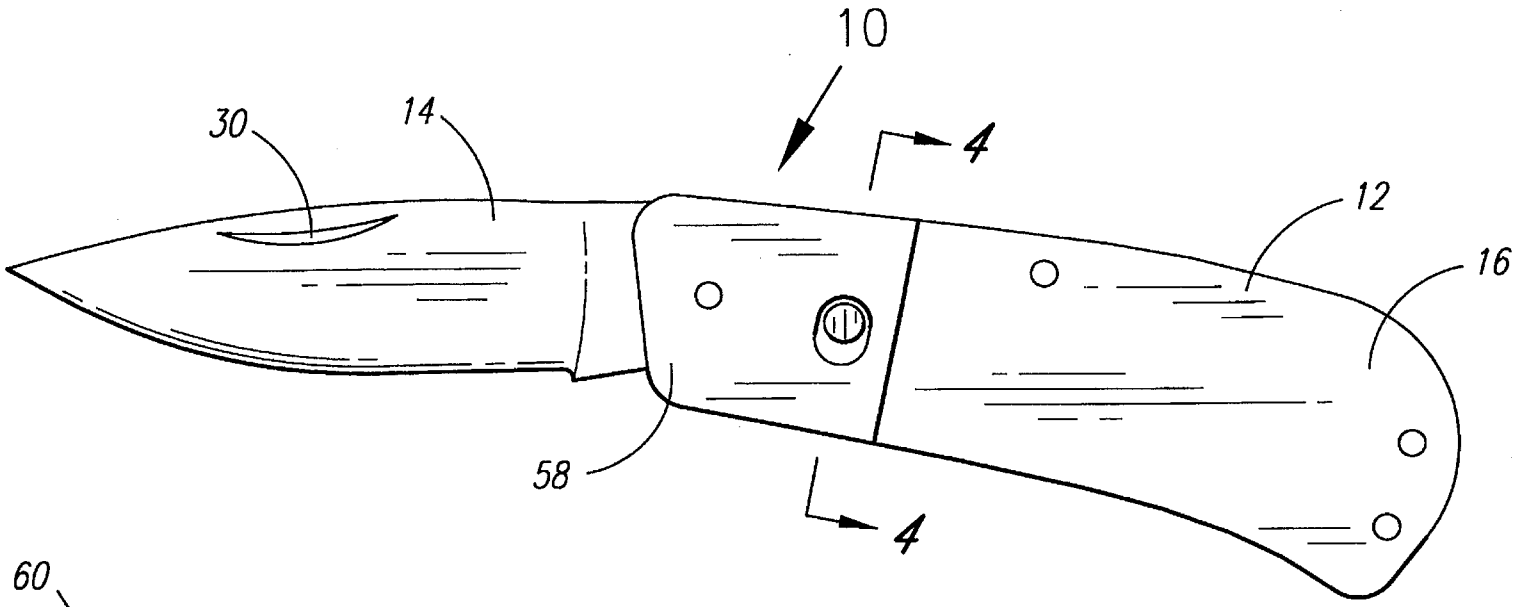
FIG. 1 is a side elevational view of a lock blade knife made in accordance with the present invention with the side covers removed and with the blade in extended position.
Figure 6:
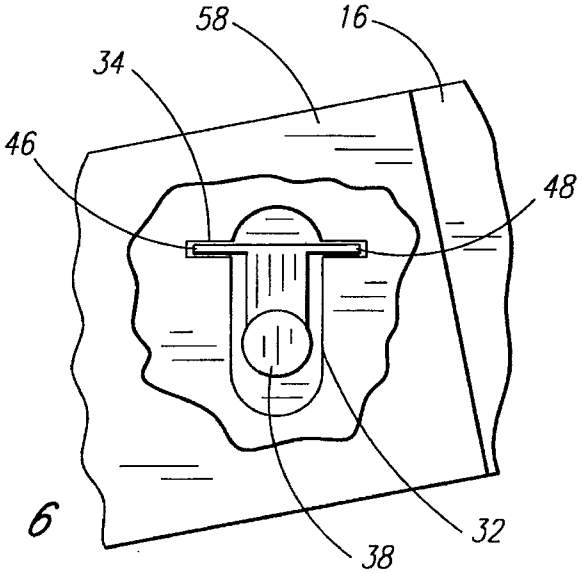

FIG. 6 is fragmentary side elevation, on a slightly enlarged scale, of the central portion of the knife shown in FIG. 1, with a portion of the cover plate broken away, and showing the button/lever positioned in a slot in the side plate of the knife.

DETAILED DESCRIPTION OF THE PREFERRED EMBODIMENTS

Figure 2:
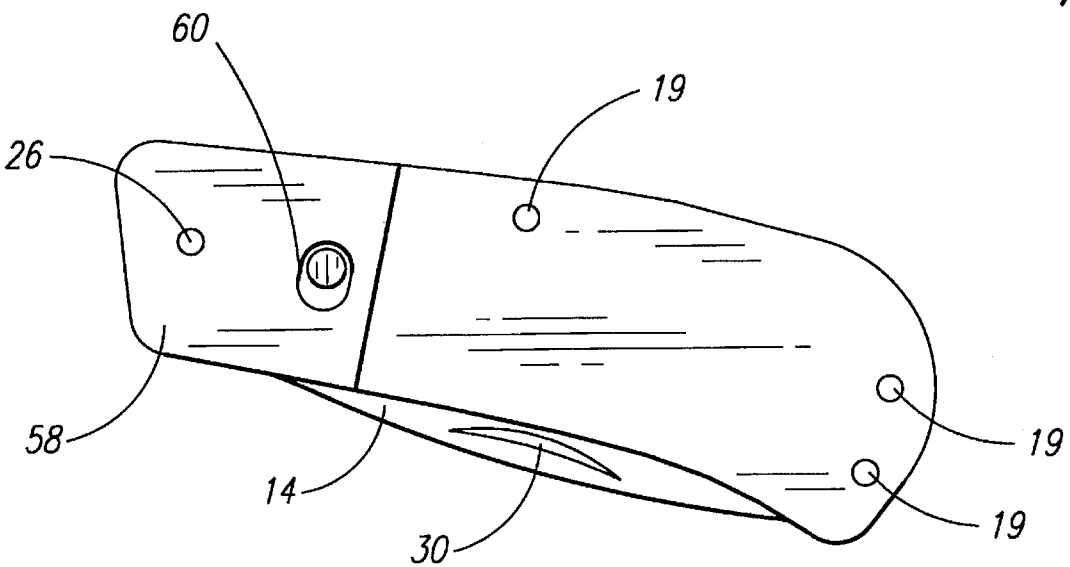
FIG. 2 is a view similar to FIG. 1 but with the blade in retracted or closed position.
Figure 3:
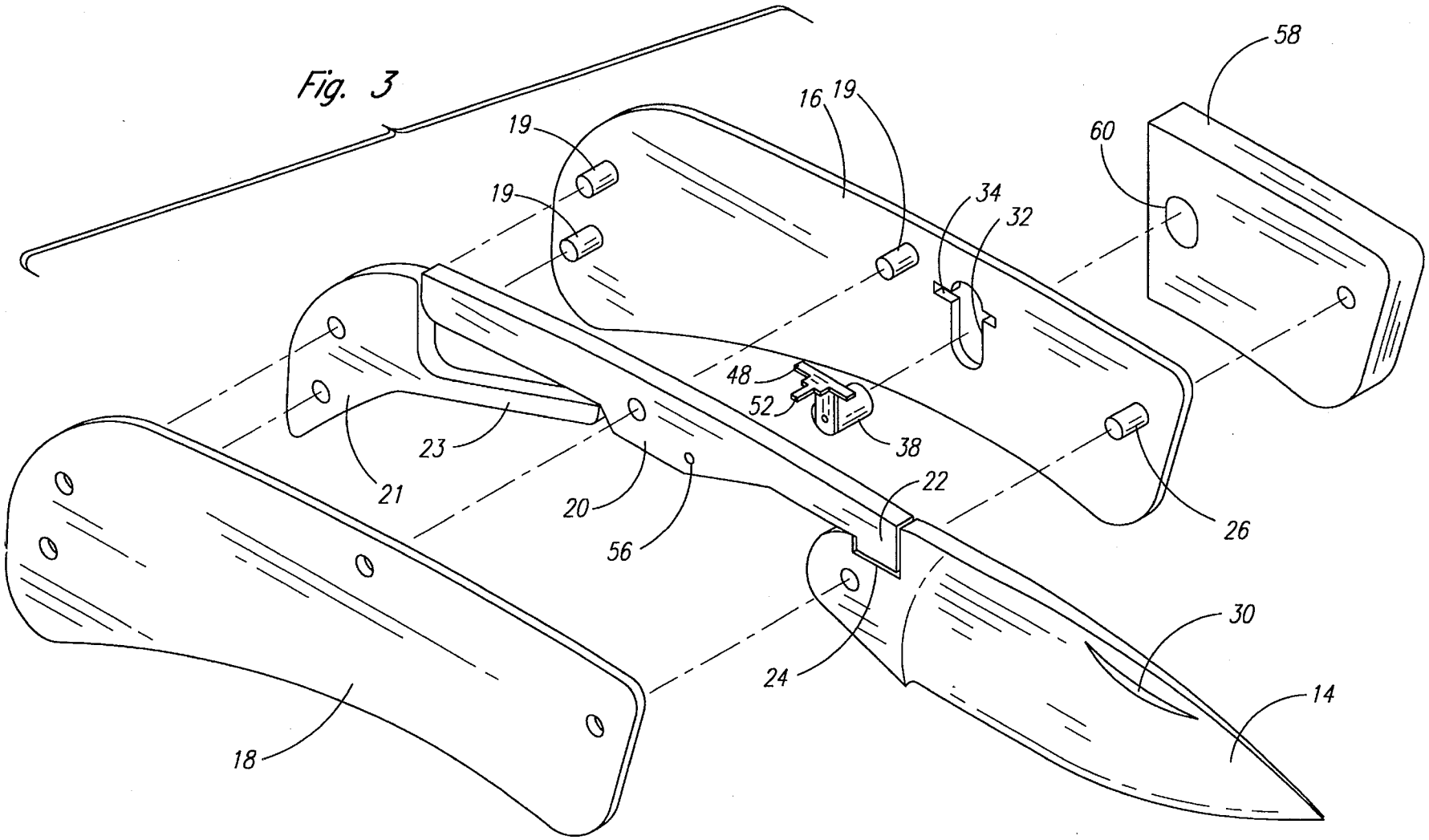
FIG. 3 is an exploded and perspective view of my knife looking from the side opposite that of FIG. 1.

FIGS. 1 through 3 show a knife 10 having a handle portion 12 and a blade 14. The handle portion includes a pair of spaced side plates 16 and 18 which enclose the blade 14 between them. Also enclosed between the side plates 16 and 18 is a spring system formed by a primary spring 20 and a cooperating secondary spring 21 which are secured to the frame of the handle by suitable rivets 19. The secondary spring 21 is provided with an arm or tang 23 which bears against the underside of the spring 20 (as best shown in FIG. 3) to the left of the pivot point of the spring 20 so as to urge the latter in a clockwise direction towards the blade 14 as will be further described hereinafter. Although the spring system illustrated and described herein is indicated as comprising two spring elements 20, 21, it is contemplated that the spring system could be comprised of a single spring element (not shown) which would be disposed between the members 16 and 18 and which would function in the same manner as the two springs 20, 21.

One end of the spring 20 is provided with a finger or pawl 22 which is adapted to be received in a notch 24 at one end of the knife blade 14. The knife blade 14 is pivotal about a pin 26. The blade 14 is also provided with a narrow recess 30 into which the user can insert his thumbnail to open the blade from the position shown in FIG. 2. It might also be mentioned, with respect to the FIG. 2 position, that the finger or pawl 22 (not shown in this figure) would be bearing against the outer curved portion (see the portion of the blade 14 in FIG. 3 to the left of the pivot point of the blade) of the knife blade 14 so that it would not normally swing open from the FIG. 2 position. Referring now to FIGS. 3 and 6, the upper plate 16 is provided with a T-shaped slot consisting of a vertical oval slot 32 and a narrow horizontal and intersecting slot 34 representing the arm of the T. An operator member or lever 36 is shown in elevation in FIGS. 4, 4*a* and 6 and in perspective in FIGS. 3 and 5. This lever consists of a button 38 attached to a piece of spring steel 40 which is bent at right angles as best shown in FIG. 5. The spring steel portion 40 shown in FIG. 5 includes a flat vertical portion 42 which connects with a horizontal portion 44 to form the right angle referred to above. The horizontal portion 44, as best shown in FIG. 5, includes a pair of horizontally extending arms 46 and 48.

Forward of the arms 46 and 48, the horizontal member 44 is of reduced width 50, this width being essentially equal to or less than the width of the T-shaped slot 32. The outer end of the horizontal portion 44 terminates in a finger 52.

FIGS. 4, 4*a* and 6 represent views of the T-shaped slot and lever on an enlarged scale. FIG. 6 represents a view looking at the slot portion only of the knife of FIG. 1. 90°. The knob 38 is shown as extending to the left of the plate 16 in FIGS. 4 and 4*a*. A cover member 58 is placed over the plate 16 so that the button 38 would project through the hole 60 in the member 58; the T-shaped slot would otherwise be covered. In any event, the lever 36 is received in the T-shaped slot such that the lowermost finger 52 is received in a hole 56 along the inboard side edge of the spring 20 to the right of its pivot point (as shown in FIG. 3).

As best shown in FIG. 6, the horizontally extending arms 46 and 48 of the member 44 bear against the edge of the transverse slot 34. Thus, when pushing down on the button 38, the ends of the arms 46 and 48 will cause the lever 36 to pivot in a counterclockwise direction as shown in FIGS. 4 and 4*a* so as to urge the spring in an outward (upper) direction with respect to the FIG. 4 or FIG. 4A position. This would cause the finger or pawl 22 to move out of the notch 24, permitting the knife blade 14 to be closed as shown in FIG. 2. Furthermore, if the button 38 were pushed downwardly when the knife blade 14 is in the position shown in FIG. 2, the pressure of the finger or pawl 22 would be removed from the mating curved portion of the knife blade 14 so that it could be more readily moved or even snapped to the open position shown in FIG. 1.

What is claimed is:

1. A lock blade knife having a handle portion and a blade, the handle portion including a pair of spaced upper and lower side plates which enclose the blade between them, the blade being pivotally mounted between the plates so as to be movable from a closed position within the handle portion to an open position where the blade extends to one side of the handle portion in alignment therewith, the side plates also enclosing a spring means which is urged towards the blade, the spring means having an end provided with a pawl which is received in a notch at an end of the knife blade when the blade is in the open position, one of said plates being provided with a T-shaped slot consisting of a vertical oval slot and a narrow horizontal and intersecting slot representing the arm of the T, a lever consisting of a button attached to a piece of spring steel which is bent at right angles, the spring steel piece including a pair of horizontally extending arms and an outwardly extending finger, the lever being received in the T-shaped slot such that the button projects out of the oval slot and the finger contacts an inboard side edge of the spring means to the right of its pivot point, the horizontally extending arms bearing against the edge of the horizontal slot, so that, when pushing down on the button, the ends of the arms will cause the lever to pivot so as to urge the spring means in a direction away from the blade, thereby causing the pawl to move out of the notch permitting the knife blade to be closed.

2. A lock blade knife as set forth in claim 1 wherein the spring means is formed by a primary spring and a cooperating secondary spring which are secured to the plates by suitable rivets, the secondary spring being provided with an arm which bears against an underside of the primary spring so as to urge the primary spring towards the blade, the pawl being on an end of the primary spring.

3. A lock blade knife having a handle portion and a blade, the handle portion including a pair of spaced upper and lower side plates which enclose the blade between them, the blade being pivotally mounted between the plates so as to be movable from a closed position within the handle portion to an open position where the blade extends to one side of the handle portion in alignment therewith, the side plates also enclosing a spring means which is urged towards the blade, the spring means having an end provided with a pawl which is received in a notch at an end of the knife blade when the blade is in the open position, one of said plates being provided with a T-shaped slot consisting of a vertical oval slot and a narrow horizontal and intersecting slot representing the arm of the T, a lever consisting of a button attached to a piece of spring steel which is bent at right angles, the spring steel piece including a flat vertical portion which connects with a horizontal portion to form said right angles bend, the horizontal portion including a pair of horizontally extending arms, an outer end of the horizontal portion terminating in a finger, the lever being received in the T-shaped slot such that the finger is received in a hole along an inboard side edge of the spring means to the right of its pivot point, the horizontally extending arms of the horizontal portion bearing against the edge of the horizontal slot, so that, when pushing down on the button, the ends of the arms will cause the lever to pivot so as to urge the spring means in a direction away from the blade, thereby causing the pawl to move out of the notch permitting the knife blade to be closed.

4. A lock blade knife as set forth in claim 3 wherein the spring means is formed by a primary spring and a cooperating secondary spring which are secured to the plates by suitable rivets, the secondary spring being provided with an arm which bears against an underside of the primary spring so as to urge the primary spring towards the blade, the pawl being on an end of the primary spring, the finger being received in a hole in the primary spring.

* * * * *